United States Patent [19]

Nitto et al.

[11] 4,369,211

[45] Jan. 18, 1983

[54] PROCESS FOR PRODUCING A HOT DIP GALVANIZED STEEL STRIP

[75] Inventors: Hajime Nitto, Tokyo; Kango Sakai; Katushi Saito, both of Kitakyushu, all of Japan

[73] Assignee: Nippon Steel Corporation, Japan

[21] Appl. No.: 228,698

[22] Filed: Jan. 26, 1981

[30] Foreign Application Priority Data

Apr. 25, 1980 [JP] Japan ..... 55-55152
Apr. 25, 1980 [JP] Japan ..... 55-55153

[51] Int. Cl.[3] ..... A23F 1/00

[52] U.S. Cl. ..... 427/349; 427/433; 427/432

[58] Field of Search ..... 427/432, 433, 349

[56] References Cited

U.S. PATENT DOCUMENTS 3,320,040 5/1967 Roe ..... 427/433
3,505,042 4/1970 Sievert et al. ..... 427/433
3,993,482 11/1976 Brunno ..... 427/433
4,029,478 6/1977 Lee ..... 427/433
4,082,868 4/1978 Schnedler et al. ..... 427/349
4,107,357 8/1978 Asakawa et al. ..... 427/432
4,172,911 10/1979 Michels ..... 427/349

*Primary Examiner*—Sam Silverberg
*Attorney, Agent, or Firm*—Wenderoth, Lind & Ponack

[57] ABSTRACT

A hot dip galvanized steel strip in which the zinc based alloy coating exhibits a satisfactory appearance and is firmly fixed to the strip substrate, which strip is produced by a process which comprises coating at least one surface of a steel strip with a melted zinc based alloy controlling the weight of the melted zinc based alloy coating and; solidifying the melted zinc based alloy coating and which process is characterized in that the zinc based alloy contains 0.1 to 2.0% by weight of magnesium and in at least a portion of a stage in which the melted zinc based alloy coating is still in the fluid state, the zinc based alloy coating is exposed to an oxygen-controlled atmosphere containing 1000 ppm or less of molecular oxygen, the controlling procedure for the weight of the melted zinc based alloy coating being carried out in the oxygen-controlled atmosphere.

13 Claims, 23 Drawing Figures

○ : Mg 0.2% Aℓ 0.2%
△ : Mg 0.5% Aℓ 0.2%
□ : Mg 1.0% Aℓ 0.2%
● : Mg 0.2%

■: FILI-FORM FAILURE OCCURRED
□: NO FILI-FORM FAILURE OCCURRED
●: DEPRESSION FAILURE OCCURRED
○: NO DEPRESSION FAILURE OCCURED

PROCESS FOR PRODUCING A HOT DIP GALVANIZED STEEL STRIP

FIELD OF THE INVENTION

The present invention relates to a process for producing a zinc-coated steel strip. More particularly, the present invention relates to a process for producing a zinc-coated steel strip having an excellent resistance to corrosion, by using a melted zinc based alloy bath.

BACKGROUND OF THE INVENTION

It is well known that hot dip galvanized steel strips have a superior anti-corrosion property and, therefore, are used as anti-corrosion materials in various fields, for example, buildings, construction, home appliances, automobile bodies, etc. In Japan, this type of zinc-coated steel strip is produced in an amount of six million metric tons per year, which corresponds to about 36% of the entire yearly production of cold-rolled steel strips.

Zinc is an inexpensive metal having a proper chemical activity. Also, zinc can be converted to a zinc compound having a dense structure which causes the corrosion of the zinc compound to be retarded. Therefore, zinc is a metal highly effective for protecting steel strips from corrosion. The corrosion rate of zinc is variable depending on the type and properties of the corrosion product and the type of the corrosional environment. For example, when zinc corrodes in an atmosphere containing a large amount of sulfurous acid gas or in an acid or alkaline environment, the resultant zinc compound is soluble in a sulfurous acid gas solution or an acid or alkali solution, respectively. Therefore, in the above-mentioned atmosphere or environment, the zinc coating layer cannot satisfactorily protect the steel strips.

However, when the zinc is coated in a neutral environment, the resultant zinc compound exhibits a dense structure and is insoluble in a neutral solution. Therefore, in this environment the zinc coating can satisfactorily protect the steel strips except in the following case. In the case where the neutral environment contains a large concentration of chlorine ions, for example, a road on which sodium chloride is sprinkled, zinc is corroded at a relatively high rate. Therefore, for example, the automobile body made of a zinc-coated steel sheet does not exhibit a satisfactory resistance to corrosion on a road on which salt is sprinkled.

In a conventional zinc-coated steel strip placed in a neutral environment, the self-sacrifice anti-corrosion activity of the zinc coating to the steel strip substrate is excessive in comparison with the necessary smallest activity thereof. Therefore, even if the corrosion rate of the zinc coating is decreased, the zinc coating can exhibit a satisfactory self-sacrifice anti-corrosion activity. For example, even if the corrosion rate of pure zinc placed in a 3% sodium chloride aqueous solution is decreased to a level of 1/20 to 1/50 of the original rate thereof, pure zinc can exhibit a satisfactory self-sacrifice anti-corrosion effect on the steel strip. Accordingly, in the above-mentioned environment, if the corrosion rate of the zinc coating is decreased to the level of 1/20 to 1/50 of the original rate, the zinc coating can exhibit an enhanced durability of 20 to 50 times the original durability of the zinc coating. Also, in order to keep the same level of durability as the original durability, the weight of the zinc coating can be reduced to a level of 1/20 to 1/50 of the original weight of the zinc coating.

In the past, zinc-coated steel strips were mainly used in buildings and construction. However, at present, the use of zinc-coated steel strips has spread to home appliances, automobiles and steel-made furniture. Therefore, zinc-coated steel strips are required to exhibit properties suitable for the above-mentioned new uses. That is, the zinc-coated steel strips should exhibit, in addition to an excellent resistance to corrosion of the steel strips, (1) an enhanced adhesion between the steel strip and the zinc coating, (2) a satisfactory appearance and no color-change, and (3) an enhanced finish coating property on the zinc coating.

The finish coating may include a chemical conversion treatment, Organic Coating and paint coating.

SUMMARY OF THE INVENTION

An object of the present invention is to provide a process for producing a hot dip galvanized steel strip having an excellent resistance to corrosion.

Another object of the present invention is to provide a process for producing a hot dip galvanized steel strip in which the zinc coating is firmly fixed to a surface of the steel strip.

Still another object of the present invention is to provide a process for producing a hot dip galvanized steel strip having a satisfactory appearance which does not change with the lapse of time.

Another object of the present invention is to provide a process for producing a hot dip galvanized steel strip which can be easily finish-coated with a coating material or finish treated with a chemical.

The above-mentioned objects can be attained by the process of the present invention which comprises the stages of:

coating at least one surface of a steel strip with a melt of a zinc-based alloy;

controlling the weight of the melted zinc-based alloy coating formed on said steel strip surface, and;

solidifying said melted zinc-based alloy coating, which process is characterized in that said zinc-based alloy contains 0.1 to 2.0% by weight of magnesium and; at least a portion of a stage in which said melted zinc-based alloy coating is still in the liquid state, said melted zinc-based alloy coating is exposed to an oxygen-controlled atmosphere containing 1000 ppm or less of molecular oxygen, said controlling procedure for the weight of said melted zinc-based alloy coating being carried out in said oxygen-controlled atmosphere.

DETAILED DESCRIPTION OF THE INVENTION

In the process of the present invention, it is essential that the zinc based alloy to be coated contains 0.1 to 2.0% by weight of magnesium. The zinc based alloy may comprise 0.1 to 2.0% by weight of magnesium and the balance consisting essentially of zinc. The magnesium contained in the alloy is remarkably effective for enhancing the resistance of the zinc based alloy coating formed on a steel strip surface to corrosion.

Figure 1:
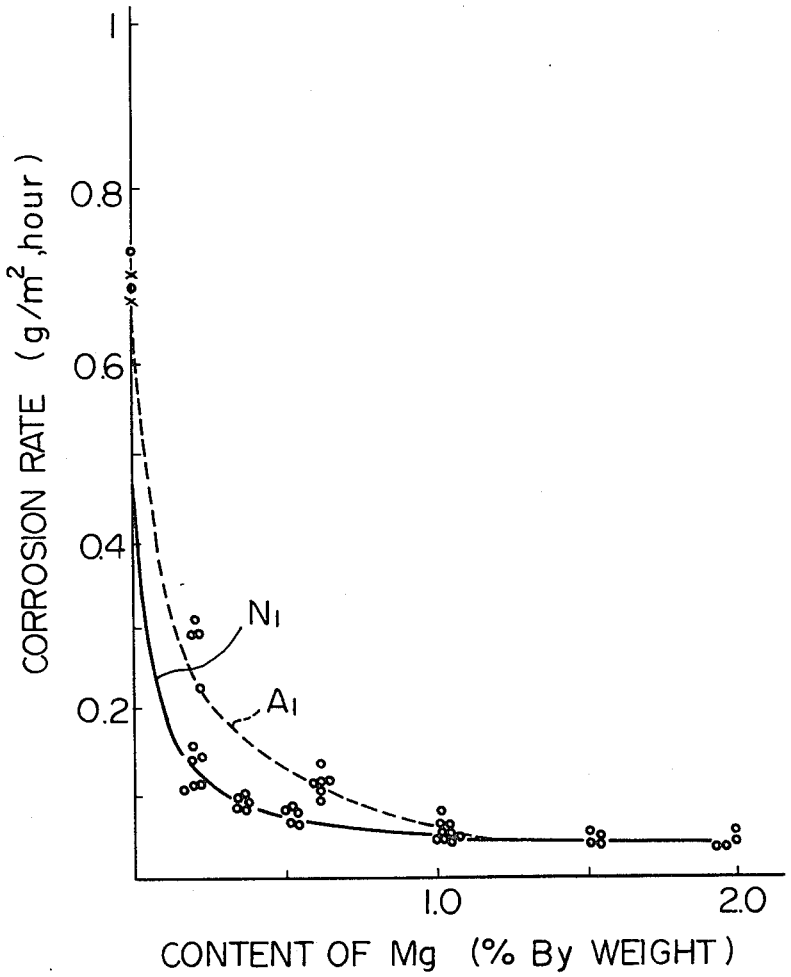
FIG. 1 is a diagram indicating a relationship between the content of magnesium in a melted zinc based alloy and the corrosion rate of a zinc based alloy-coated steel strip.

For example, referring to FIG. 1, a steel strip was coated with a mixture (Nl) of an electrolytic grade of zinc (purity-99,97%) with magnesium in an amount as indicated in FIG. 1 by using a Sendzimir Type hot dip galvanizing test machine. In the same manner as that mentioned above, another steel strip was coated with another zinc based alloy (Al) containing magnesium in an amount indicated in FIG. 1, 0.22% by weight of aluminum and impurities containing 0.1% by weight of lead, 0.01% by weight of cadmium and 0.02% by weight of iron.

The resultant coated steel strips were subjected to a salt spray test set forth in Japanese Industrial Standard (JIS) Z 2371, for three days. The weight loss of each strip due to the above-mentioned test was measured to determine the corrosion rate of each strip.

FIG. 1 clearly shows that the addition of magnesium to zinc is remarkably effective for decreasing the corrosion rate of the zinc based alloy-coated steel strip. For instance, the corrosion rate of the steel strip coated with a zinc based alloy containing 0.5% by weight of magnesium corresponds to 1/7 that of the steel strip coated with a zinc or zinc alloy containing no magnesium. Also, the corrosion rate of the steel strip coated with a zinc based alloy containing 1.0% by weight of magnesium corresponds to 1/10 that of the steel strip coated with a no magnesium-containing zinc or zinc alloy. However, as FIG. 1 clearly shows, the anti-corrosion effect of magnesium is saturated at a content of about 2.0% by weight thereof in the zinc based alloy. That is, the anti-corrosion effect of a zinc based alloy containing more than 2.0% by weight of magnesium is approximately identical to that containing 2% by weight of magnesium. Also, FIG. 1 clearly shows that in order to produce a satisfactory anti-corrosion effect, it is necessary that the content of magnesium in the zinc alloy is at least 0.1% by weight. Therefore, in the process of the present invention, it is important that the content of magnesium in the zinc based alloy is in a range of from 0.1 to 2.0% by weight.

The zinc based alloy usable for the process of the present invention may contain 0.5% or less of aluminum addition to magnesium. That is, the zinc based alloy may comprise 0.1 to 2.0% of magnesium, 0.5% or less of aluminum and the balance consisting essentially of zinc. The aluminium contained in the zinc based alloy is effective for enhancing the adhesion of the zinc based alloy coating to the surface of the steel strip.

Figure 2:
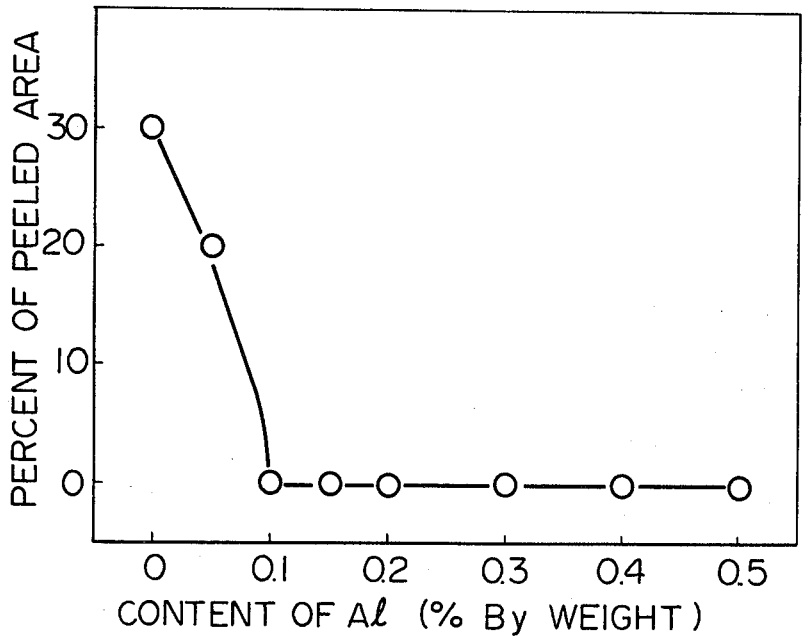
FIG. 2 is a diagram showing a relationship between the content of aluminum in a zinc based alloy coating on a steel strip surface and the adhesion of the zinc based alloy coating to the steel strip surface.

FIG. 2 shows a relationship between the content of aluminium in the zinc based alloy and the adhesion (bonding strength) of the zinc based alloy coating to the steel strip surface. Each of eight steel strips were coated with a melt of a zinc based alloy containing 1.0% by weight of magnesium and 0, 0.05, 0.1, 0.15, 0.2, 0.3, 0.4 or 0.5% by weight of aluminum added to an electrolytic grade of zinc. The weight of the zinc-based alloy coating was 50 g/m$^2$. In order to determine the peeling resistance of the coated zinc based alloy layer, each coated steel strip was subjected to a ball-impact test in which an iron ball having a diameter of 25 mm was hand thrown against the plated zinc alloy layer, and an adhesive tape was adhered onto the surface of the zinc-based alloy coating and, then, peeled out therefrom so as to allow a portion of the coating to be peeled out from the steel strip surface. The bonding strength of the zinc-based alloy coating was represented by a ratio of the area in which the zinc-based alloy coating was removed to the entire area. That is, the larger the adhesion, the smaller the area ratio.

FIG. 2 clearly shows that the adhesion of the zinc-based alloy coating is remarkably enhanced by adding 0.1% by weight or more of aluminum to the zinc based alloy.

In order to investigate the relationship between the weight of the zinc-based alloy coating on a steel strip surface and an adhesion of the zinc based alloy coating to the steel strip surface, a steel strip was immersed in a melted zinc based alloy (A) containing 0.2% by weight of magnesium and 0.2% by weight of aluminium, a melted zinc-based alloy (B) containing 0.5% by weight of magnesium and 0.2% by weight of aluminum, a melted zinc based alloy (C) containing 1.0% by weight of magnesium and 0.2% by weight of aluminum and a melted zinc based alloy (D) containing 0.2% by weight of magnesium and no aluminum, respectively. The immersed steel strip was withdrawn from the melted zinc based alloy and a wiping gas was jetted onto the melted zinc-based alloy coating formed on the steel strip surface to adjust the weight of the coating to a desired value. After the coating procedure was completed, the adhesion of the zinc-based alloy coating to the steel strip surface was measured by a ball-impact test. The results are indicated in FIG. 3.

Figure 3:
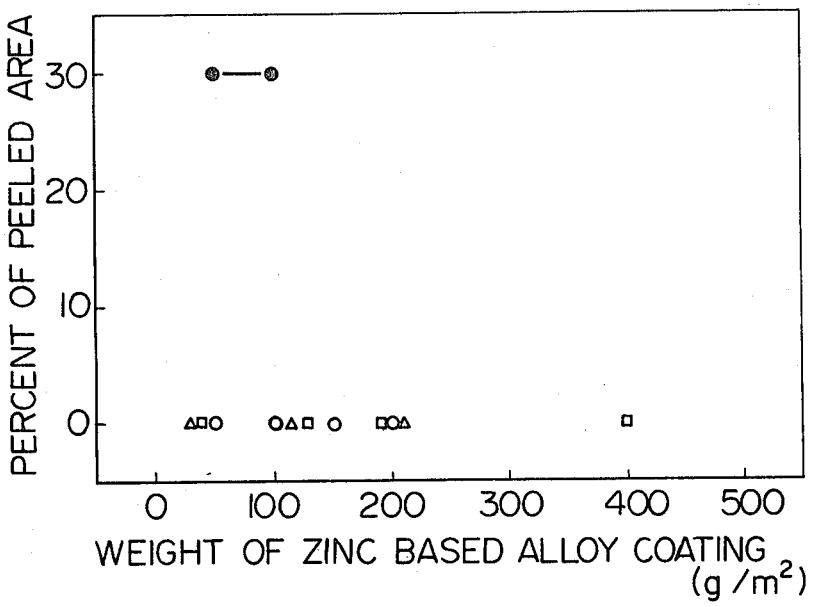
FIG. 3 is a diagram showing a relationship between the weight of a zinc based alloy coating on a steel strip surface and the adhesion of the zinc based alloy coating to the steel strip surface.

FIG. 3 clearly shows that the zinc-based alloys (A), (B) and (C) containing aluminum in addition to magnesium exhibited an excellent adhesion and the zinc-based alloy (D) containing no aluminum exhibited a poor adhesion.

Usually, an addition of 0.1% by weight or more of aluminum is effective for enhacing the adhesion of the zinc-based alloy coating to the steel strip surface. However, an addition of 0.5% by weight or more of aluminum may sometimes cause the resistance of the zinc-based alloy coating to corrosion to be decreased. This is, because a combination of a large content of aluminum with tin or lead in the zinc-based alloy causes an intergranular corrosion of the zinc-based alloy to be accelerated.

As stated above, the zinc-based alloy containing less than 0.1% by weight of aluminum exhibits a poor adhesion to the steel strip. However, when the steel strip surface is pre-plated with tin, nickel or copper before coating with the zinc-based alloy, the adhesion of the zinc-based alloy containing less than 0.1% by weight of aluminum to the pre-plated steel strip surface becomes similar to that of the zinc-based alloy containing 0.1% by weight or more of aluminum to a non-pre-plated steel strip surface. This is because the layer of the pre-plated metal hinders the undesirable diffusion of the steel and the zinc-based alloy into each other. The pre-plating procedure is carried out by placing a cathode consisting of a steel strip in a plating bath containing tin, nickel or copper ions. The weight of the pre-plated metal is preferably in the range of from 0.001 to 1 g/m$^2$. In another process, the pre-plating procedure is carried out by placing a cathode consisting of a steel strip in a bath containing ions of the metal to be plated and a degreasing agent and/or a pickling acid. This method is effective for carrying out concurrently the pre-plating procedure and the degreasing procedure. The pre-plating procedure may be carried out by any other method as long as the metal to be pre-plated can be firmly bonded to the steel strip surface. The pre-plated tin, nickel or copper layer is effective for enhancing the zinc coating property of a surface of a steel strip containing a high concentration of silicon, manganese and/or aluminum and, therefore, exhibiting a poor coating property, for example, high tensile steel, killed steel or a continuously casted steel strip.

The surface of a steel strip coated with a zinc-based alloy containing magnesium alone or both magnesium and aluminum sometimes darkens in the atmosphere with the lapse of time due to the oxidation of the surface.

The inventors of the present invention discovered from their research that the darkening phenomenon of the coated zinc-based alloy surface could be prevented by adding tin to the zinc-based alloy.

Each of seven steel strips was coated with a melted zinc-based alloy containing magnesium, aluminum and tin in the amounts indicated in Table 1. A portion of each coated steel strip was treated by applying an aqueous solution of 2% by weight of chromic anhydride onto the surface of the steel strip, and by drying the aqueous solution layer by blowing hot air thereto. The weight of the resultant chromate on the surface of the coated steel strip was in the range of from 10 to 25 $mg/m^2$ in terms of chromium. The remaining portion of the coated steel strip was not chromated.

The chromated portion and the non-chromated portion of each steel strip were placed in a closed chamber at a constant temperature of 38° C. in the following manner. Half of each of the chromated portion and the remaining non-chromated portion of the steel strip was superimposed on others and wrapped with a waterproof wrapping sheet. The other half of each of the chromated and non-chromated portions was directly exposed to the atmosphere, independently from the others. The time period in months necessary for darkening each surface was measured. The results are indicated in Table 1.

TABLE 1

| Experiment No. | Zinc-based alloy Mg (%) | Al (%) | Sn (%) | Exposed non-treated | Exposed chromated | Wrapped non-treated | Wrapped chromated |
|---|---|---|---|---|---|---|---|
| 1 | 0 | 0.2 | — | >6 months | >6 months | >6 months | >6 months |
| 2 | 0.3 | 1 | — | 3 months | 1 months | 3 months | 1 months |
| 3 | 0.5 | 0.2 | — | 3 months | 3 months | 3 months | 3 months |
| 4 | 1.0 | 0.2 | — | 1 month | 0.5 months | 1 month | 0.5 months |
| 5 | 0.5 | 0.2 | 0.1 | >6 months | >6 months | >6 months | >6 months |
| 6 | 1.0 | 0.2 | 0.2 | >6 months | >6 months | >6 months | >6 months |
| 7 | 1.0 | 0.2 | 0.5 | >6 months | >6 months | >6 months | >6 months |

Table 1 shows that the coating of zinc-based alloys 2, 3 and 4 containing both magnesium and aluminum but no tin were darkened within 3 months. However, the coating of zinc-based alloy 1 containing aluminum but not magnesium and tin were much less darkened. Also, the coating of zinc-based alloys 5, 6, 7 containing aluminum, magnesium and tin were highly resistant to the darkening phenomenon. That is, the addition of tin to the zinc based alloy containing both magnesium and aluminum was significantly effective for avoiding the darkening phenomenon on the zinc-based alloy coating.

Table 1 also shows that the darkening phenomenon on the zinc-based alloy coating was accelerated with an increase in the content of magnesium in the zinc based alloy.

Figure 4:
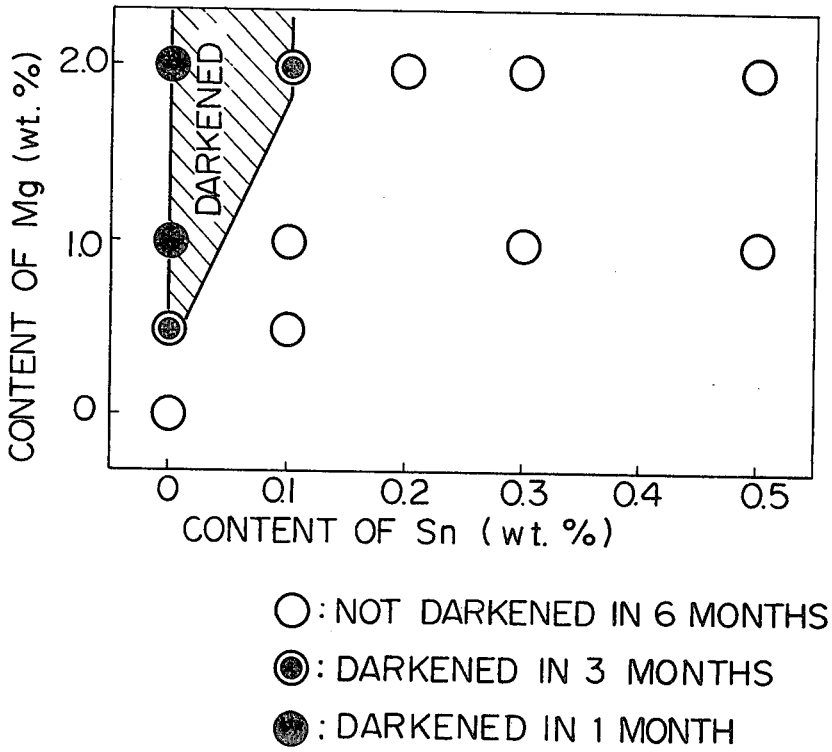
FIG. 4 is a diagram showing the relationship between the contents of tin and magnesium in a zinc based alloy coating on a steel strip surface and a darking phenomenon of the zinc based alloy coating.

From the data indicated in Table 1, FIG. 4 was prepared. FIG. 4 shows the relationship between the darkening phenomenon and the contents of magnesium and tin in the zinc-based alloy coating. Referring to FIG. 4, when a zinc-based alloy coating contains magnesium and tin in amounts falling in the hatched area, the coating is darkened by placing it in an air atmosphere at a temperature of 38° C. for 6 months or less. However, when 0.1% by weight or more of tin is added to a zinc-based alloy containing magnesium, the resultant zinc based alloy is remarkably resistant to the darkening phenomenon.

The inventors of the present invention also discovered that in order to prevent undesirable intergranular corrosion of the zinc-based alloy, it is preferable that the content of tin in a zinc alloy is in the range of from 0.1% by weight to an upper limit A satisfying the equation:

$$A\ (\%) = 1.07 - 1.33 \times B$$

wherein B represents a % amount of aluminum.

Figure 5:
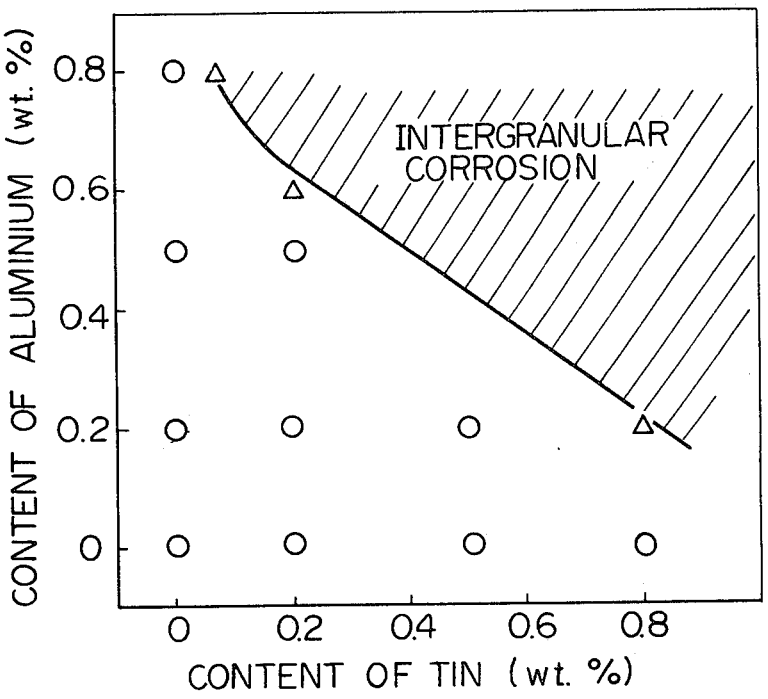
FIG. 5 is a diagram indicating the relationship between the contents of tin and aluminium in a zinc based alloy coating on a steel strip surface and the occurrence of intergranular corrosion in the zinc based alloy coating.

A corrosion test was applied to a number of steel strips each coated with a melted zinc-based alloy containing 0.5% by weight of magnesium and an amount as indicated in FIG. 5 of aluminum and tin. The corrosion test was carried out by placing the coated steel strips in a steam atmosphere at a temperature of 100° C. for two weeks. After the test was completed, the occurrence of intergranular corrosion on the zinc-based alloy coating was measured. The results of the test are indicated in FIG. 5. Referring to FIG. 5, when the contents of aluminum and tin fell within the hatched area, the resultant zinc-based alloy coating were intergranularly corroded. In order to avoid the intergranular corrosion, the amount A of tin and the amount B of aluminum should satisfy the above-mentioned equation.

In consideration of desirable resistance to corrosion, adhesion to the steel strip surface, resistance to darkening phenomenon and resistance to intergranular corrosion, of the zinc-based alloy coating, the amounts of magnesium, aluminum and tin in the zinc alloy should be determined. A preferable zinc-based alloy comprises 0.1 to 2.0% by weight of magnesium, 0.1 to 5.0% by weight of aluminum, tin which is in an amount of from 0.1% by weight to an upper limit A satisfying the equation:

$$A\ (\%) = 1.07 - 1.33 \times B$$

wherein B represents a % amount of aluminum, and the balance consisting essentially of zinc.

As stated above, tin is significantly effective for preventing the darkening phenomenon on the zinc-based alloy coating. Also, bismuth, and silicon prevent the darkening phenomenon but its effectiveness is less than that of tin. Therefore, in the process of the present invention, at least a portion of tin to be contained in the zinc-based alloy may be replaced by at least one member selected from the group consisting of bismuth and silicon.

It was observed by the inventors of the present invention that magnesium contained in the zinc-based alloy causes the spangling property of the resultant zinc-based alloy coating to be reduced. However, sometimes, it is required that the zinc-based alloy coating exhibit an enhanced spangling property. In this case, it is required that the zinc-based alloy coating contains lead, tin, antimony and/or bismuth which are effective for enhacing the spangling property. For this purpose, the commercially used zinc-based alloy contains 0.1 to 0.25% by weight of lead. However, lead contained in the zinc-based alloy causes the intergranular corrosion of the resultant zinc-based alloy coating to be accelerated, even if the content of lead is very small. Accordingly, in order to prevent intergranular corrosion, it is desirable that the content of lead in the zinc-based alloy be as small as possible, preferably, 0.01% by weight or less.

It was discovered by the inventors of the present invention that the spangling property of a zinc-based alloy containing magnesium but no lead can be enhanced by adding tin, bismuth and/or antimony to the zinc-based alloy. Also, it was noted that antimony is significantly effective for enhancing the spangling property of the zinc-based alloy although it is not effective for preventing the darkening phenomenon or the zinc-based alloy coating. Therefore, in the tin-containing zinc-based alloy, at least a portion of tin may be replaced by antimony.

As stated hereinbefore, magnesium is remarkably effective for improving the resistance of the resultant zinc based alloy to corrosion. Also, magnesium contained in the zinc based alloy is effective for enhancing the finish-coating property of the resultant zinc based alloy coating. Accordingly, the zinc-coated steel strip of the present invention exhibits an excellent finish-coating property.

Usually, before the finish-coating procedure is applied to a zinc based alloy-coated steel strip, the surface of the zinc based alloy coating is treated with a commercial phosphate aqueous solution in order to enhance the adhesion between the finish-coat and the zinc based alloy coating. The magnesium-containing zinc-based alloy coating can be treated with a commercial phosphate aqueous solution under the same conditions as those applied to a conventional zinc based alloy coating containing no magnesium. As a result of the treatment, a stable phosphate film is firmly formed on the surface of the zinc-based alloy coating.

The treated zinc based alloy coating can be firmly finish-coated by any conventional finish-coating method, for example, cationic or anionic electrodeposition coating method and baking coating method, which are used for paint-coating automobiles, under-coating and top-coating methods for color steel plates, and baking coating method for home appliances.

The excellent paint-coating property of the zinc-coated steel strip of the present invention will be illustrated by means of experiments as follows.

Each of fine steel strips was coated with a melted zinc-based alloy containing aluminum, magnesium, tin and iron in amounts as indicated in Table 2. The amount of the resultant zinc-based alloy coating is indicated in Table 2.

Each zinc-coated steel strip was pre-treated with a zinc phosphate-containing a pre-treating agent in the usual manner. Each pre-treated steel strip was paint-coated by means of an anionic electrodeposition coating method. The thickness of the paint-coat was about 20 microns.

A cross-shaped cut was formed on a coating layer on each test piece of the coated strip so that the cut portion of the steel strip substrate was exposed to the atmosphere. The cut, coated steel strip was subjected to a salt spray test in accordance with Japanese Industrial Standard (JIS) Z 2371 for 1,000 hours. A portion around the cross-shaped cut was defected. The width (mm) of the defected portion was measured. The results are indicated in Table 2.

Separately, each test piece of the coated steel strip was subjected to a salt spray test in which a NaCl solution was sprayed on the coated steel strip. The salt spray test was continued until a portion corresponding to 50% of the entire area of the surface of the coated steel strip became covered with red rust. The salt spraying time was measured. The resistance of the coated steel strip to rusting was represented by the measured salt spraying time. The results are indicated in Table 2.

TABLE 2

| Experiment No. | Weight of zinc-based alloy coating ($g/m^2$) | Content of alloyed metal in zinc-based alloy coating (%) Al | Mg | Sn | Fe | Width of defected portion (mm) | Resistance to rusting (hours) |
|---|---|---|---|---|---|---|---|
| 1 | 90 | 0.2 | 0 | — | — | > | 150 |
| 2*1 | 60 | " | 0 | — | 7–10 | 3 | 50 |
| 3 | 44 | " | 0.5 | — | 0 | 4 | >2000 |
| 4*1 | 40 | " | 0.5 | — | 7–10 | 1 | >2000 |
| 5 | 40 | " | 0.5 | 0.2 | — | 3 | >2000 |

Note:
*1—The coating procedure was carried out by a galvannealing method.

Table 2 shows that the coated steel strip of Experiments 3, 4 and 5 in accordance with the process of the present invention exhibited excellent resistance to corrosion, and that the paint coating was very firmly fixed onto the chemical treated zinc based alloy coating on the steel strip surface.

The magnesium contained in the zinc-based alloy coating causes the resultant coated steel strip to exhibit the above-mentioned various advantages. However, the magnesium also causes various disadvantages, for example, increased cross-formation, difficutly in controlling the weight of the melted zinc-based alloy coating, undesirable formation of skimming on the melted zinc-based alloy coating, undesirable promotion of darkening or discoloring phenomenon, uneven plating results and poor spangling properties. Accordingly, when the magnesium-containing zinc based alloy is used in a conventional hot dip galvanizing method, it is difficult to smoothly carry out the hot dip galvanizing procedure and the resultant product exhibits an unsatisfactory quality. Under these circumstances, the inventors of the present invention studied a method for smoothly carrying out the hot dip galvanizing procedure using the melted zinc-based alloy containing magnesium and attained the present invention.

In the case where a steel strip is coated with a melted zinc-based alloy containing magnesium, it is important that the concentration of oxygen in the atmosphere around the melted zinc based alloy bath and the melted zinc based alloy coating formed on the steel strip, is controlled to a limited value.

Generally, magnesium is strongly reactive with oxygen. The oxidized magnesium forms a dross in the bath of the melted zinc alloy. In the conventional hot dip galvanizing process, a steel strip is immersed in a bath of melted zinc alloy and withdrawn from the bath, and, thereafter, a stream of air is jetted onto the melted zinc based alloy coating so as to control the total weight of the coating. This control procedure causes the magnesium in the melted zinc based alloy coating to be oxidized by oxygen in the air. This gas jet wiping procedure sometimes results in an undesirable splashing phenomenon on the melted zinc based alloy coating and the oxidation results in the formation of dross in the melted zinc based alloy bath. Accordingly, as stated above, the conventional hot dip galvanizing method cannot be applied to the magnesium-containing zinc alloy. In order to prevent the formation of dross, it was attempted to use a non-oxygen-containing gas in place of an air jet stream. However, the absence of oxygen in the jet stream causes a portion of the zinc alloy melt to be vaporized. The vaporized metal is condensed on the inside surface of the hot dip galvanizing apparatus. The condensation results in various disadvantages in the hot dip galvanizing process. That is, the non-oxygen-containing gas cannot prevent the formation of dross.

Figure 7:
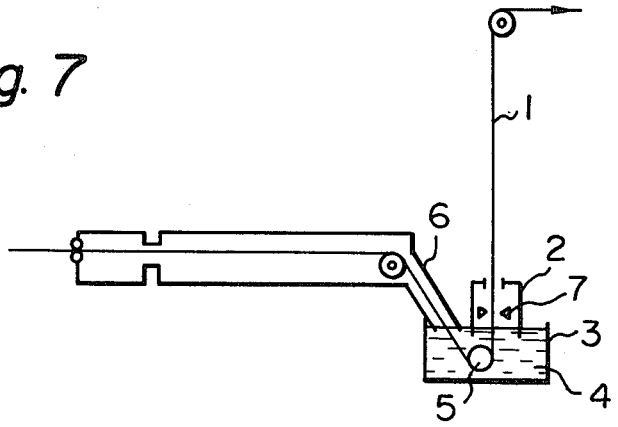
FIG. 7 shows an explanatory view of an embodiment of the apparatuses for carrying out the process of the present invention, by using which apparatus the relationship as shown in FIG. 6 was observed.

For example, a steel strip was hot dip galvanizing with a zinc alloy containing 0.5% by weight of magnesium at a strip speed of 80 m/min by using a hot dip galvanizing apparatus as indicated in FIG. 7. Referring to FIG. 7, a steel strip 1 was fed into a galvanizing pot 3 containing a melted zinc based alloy having a temperature of 450° C. through a snout 6. The steel strip 1 traveled in the melted zinc based alloy bath through a sink roll 5 and, then, was withdrawn from the bath. The withdrawn steel strip was introduced into a oxygen-controlled atmosphere defined by a sealing box. The concentration of molecular oxygen in the oxygen-controlled atmosphere was adjusted to a desired value. The oxygen-controlled atmosphere in the sealing box 2 is composed of a first zone in which the weight of the melted zinc based alloy coating is adjusted to a desired value by jetting a wiping gas onto the coating, and a second zone in which the coating is cooled to a desired temperature. In the sealing box 2, a pair of nozzles 7 are arranged. A wiping gas was jetted through the nozzles 7 onto both surfaces of the coated steel strip 1, in order to control the weight of the melted zinc based alloy coating on the steel strip surfaces. The concentration of molecular oxygen in the atmosphere in the sealed box 2 was measured by sampling portions of the gas at locations 100 mm above and below the nozzles 7 and by subjecting the sampled gas to a highly sensitive oxygen meter.

Figure 6:
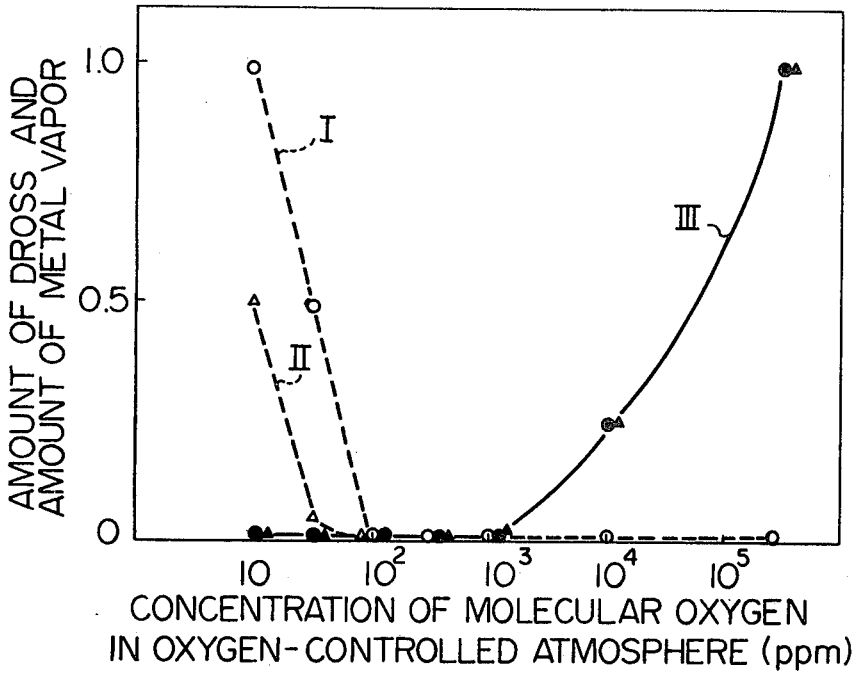
FIG. 6 is a diagram showing the relationship between the content of molecular oxygen in an oxygen-controlled atmosphere and the amounts of dross and vapor generated from each of three different types of melted zinc based alloy coatings each on a steel strip surface introduced into said atmosphere while the weight of each coating is adjusted to a desired value.

The results are indicated in FIG. 6. Referring to FIG. 6, Curve I indicates a relationship between the concentration of molecular oxygen in the oxygen-controlled atmosphere defined by the sealed box 2 and the amount of metal vapor generated from the melted zinc based alloy which consisted of 0.5% by weight of magnesium and the balance consisting of a 99.99% electrolytic grade zinc, in the first zone of the oxygen-controlled atmosphere. The amount of the metal vapor in each first zone of oxygen-controlled atmosphere was represented by a ratio of the amount of the metal vapor in each first zone to that in an atmosphere containing about 10 ppm molecular oxygen. Curve I clearly shows that when the concentration of molecular oxygen in the first zone is 100 ppm or more, no metal vapor is generated.

Curve II in FIG. 6 indicates a relation between the concentration of molecular oxygen in the first zone of the oxygen-controlled atmosphere and the amount of metal vapor generated from a melted zinc alloy bath consisting of 0.2% by weight of aluminum, 0.1% by weight of lead, 0.01% by weight of cadmium, 0.015% by weight of iron and the balance consisting essentially of zinc, in the first zone. In the case of the above-mentioned aluminum-containing zinc alloy bath, no metal vapor is generated when the concentration of molecular oxygen in the first zone is 50 ppm or more.

Curve III in FIG. 6 shows the relationship between the concentration of molecular oxygen in the first zone of the oxygen-controlled atmosphere and the amount of dross produced in the same aluminum-containing zinc alloy bath as that described in the above paragraph concerning Curve II. The amount of dross generated in each first zone was represented by a ratio of the amount of the metal vapor generated in each first zone to that generated in the air atmosphere. Curve III clearly shows that when the concentration of molecular oxygen in the first zone is 1000 ppm or less, no dross is formed. However, if the concentration of molecular oxygen is more than 1000 ppm, the amount of dross remarkably increases with the increase in the concentration of molecular oxygen.

From the results as indicated in FIG. 6, it is clear that the weight of the zinc based alloy coating formed on the steel strip can be adjusted to a desired value by adjusting the concentration of molecular oxygen to a desired low value. Also, the undesirable formation of dross can be prevented by adjusting the concentration of molecular oxygen to a predetermined low value. Therefore, by adjusting the concentration of the molecular oxygen to a low value, it becomes possible to carry out the hot dip galvanizing procedure at a high speed. That is, the conventional hot dip galvanizing procedure is carried out at a speed of about 150 m/min or less, because the high speed causes an undesirable splash from the melted zinc based alloy bath together with the formation of dross in the melted zinc based alloy bath to be promoted. However, by adjusting the concentration of molecular oxygen in the first zone to a low value, it becomes possible to carry out the hot dip galvanizing procedure at a high speed of more than 150 m/min, even when the melted zinc based alloy bath contains magnesium. In the conventional hot dip galvanizing process in which the zinc based alloy coating is produced in the air atmosphere and the wiping gas for controlling the weight (thickness) of the zinc based alloy coating consists of air, an increase in the jetting pressure of the wiping gas effective for decreasing the weight (thickness) of the zinc based alloy coating. However, the increase in the jetting pressure results in an undesirable increase in the amount of splashing. The increase in splashing causes the hot dip galvanizing procedure to become difficult. When the conventional hot dip galvanizing process is carried out without controlling the concentrations of molecular oxygen in a cooling atmosphere a large amount of dross is produced in the melted zinc based alloy bath or a large amount of metal vapor is generated from the bath. However, by controlling the concentration of the molecular oxygen in the first zone in the oxygen-controlled atmosphere to a limited small amount, a thin coating of the melted zinc based alloy can be obtained without difficulty.

The decrease in the concentration of molecular oxygen in the first zone of the oxygen-controlled atmosphere is effective for decreasing the weight of the resultant zinc based alloy coating without increasing the jetting pressure of the wiping gas. For example, the weight of the zinc based alloy coating which has been formed in a concentration of molecular oxygen of 100 ppm in the first zone of the oxygen-controlled atmosphere corresponds to about 80% of that which has been formed in the air atmosphere.

That is, the process of the present invention could make it possible to carry out the hot dip galvanizing process at a high speed of 150 m/min or more and to have a very thin zinc based alloy coating.

In the conventional hot dip galvanizing process in which a cooling atmosphere and a wiping gas each consisting of atmospheric air, a surface portion of the zinc based alloy coating is easily oxidized. The oxidation results in the formation of a solid skin layer which covers the remaining melted zinc based alloy coating which is still in a fluidal state. When a wiping gas is jetted onto the surface of the melted zinc based alloy coating, the resultnat solid skin layer is wrinkled. After the zinc based alloy coating is completely solidified, the resultant surface of the coating is wrinkly. Also, the formation of the solid skin layer makes the adjustment of the weight of the zinc based alloy coating to a desired value difficult.

Figure 8:
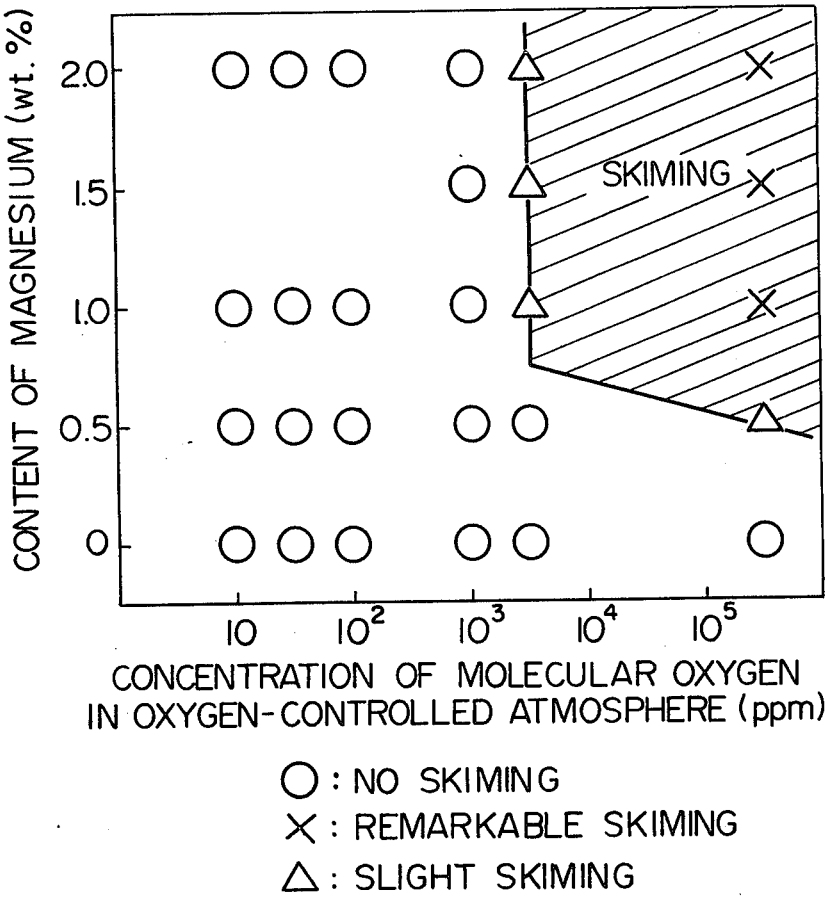
FIG. 8 shows the relationship between the contents of molecular oxygen in said oxygen-controlled atmosphere and of magnesium in a melted zinc based alloy coating on a steel strip surface and the occurrence of a skimming phenomenon in the melted zinc based alloy coating.

For example, each of a number of steel strips was coated with a melted zinc based alloy containing magnesium in the amount as indicated in FIG. 8 at a temperature of 450° C. at a strip speed of 80 m/min, and a wiping gas containing molecular oxygen in the concentration as indicated in FIG. 8 was jetted onto the zinc based alloy coating through a wiping gas slit having a thickness of 0.6 mm and located at a location spaced 10 mm from the surface of the melted zinc based alloy coating, under a pressure of 1.0 kg/cm$^2$. In each coating procedure, a skimming phenomenon was observed. The results are indicated in FIG. 8. In FIG. 8, a relationship in the skimming phenomenon of the concentration of molecular oxygen in the first zone in the oxygen-controlled atmosphere and the amount of magnesium in the zinc based alloy, is indicated. The skimming phenomenon occurred in the hatched region in FIG. 8. That is, when a melted zinc based alloy containing 2.0% by weight or less of magnesium was used, no skimming phenomenon occurred in a first zone of the oxygen-controlled atmosphere containing 1000 ppm or less of molecular oxygen. For example, when the zinc based alloy contained 0.5% by weight of magnesium, no skimming phenomenon was found even in a first zone of the oxygen-controlled atmosphere containing 3000 ppm of molecular oxygen.

That is, it is clear that in order to produce the hot dip galvanizing steel strip which has been hot dip galvanized and has a smooth surface by using a melted zinc based alloy containing magnesium, it is necessary that the content of magnesium be 2.0% by weight or less and the concentration of molecular oxygen in the oxygen-controlled atmosphere be 1000 ppm or less.

Usually, the amount (thickness) of the zinc based alloy coating is adjusted to a desired value by jetting a wiping gas onto the surface of the zinc based alloy coating while the zinc based alloy coating is in a fluidal state. The coating weight-adjusting procedure is applied to the zinc based alloy coating at a location just above the level surface of the melted zinc based alloy bath. After this procedure, the alloy coating is exposed to a oxygen-controlled atmosphere in order to be solidified. During the solidification procedure, sometimes, an undesirable depression failure and/or fili-form failure occur.

Figure 9:
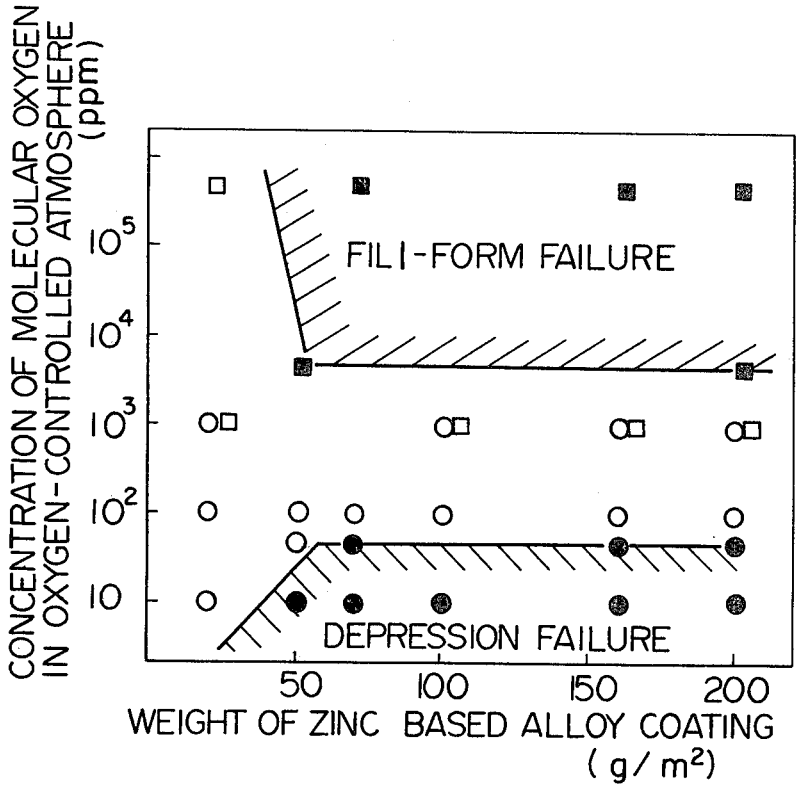
FIG. 9 shows the relationships between the content of molecular oxygen in an oxygen-controlled atmosphere, the amount of a melted zinc based alloy coating on a steel strip surface and occurrences of depression failure and fili-form failure in the melted zinc based alloy coating.

For example, in each of a number of hot dip galvanizing procedures a steel strip was coated with a melt of a zinc based alloy containing 0.5% or 1.0% by weight of magnesium, 0.2% by weight of aluminium, 0.1% by weight of lead, 0.01% by weight of cadmium and 0.01% by weight of iron, and the melted zinc based alloy coating was solidified in an oxygen-controlled atmosphere containing molecular oxygen in a concentration as indicated in FIG. 9. Also, the weight of the melted zinc based alloy coating was adjusted to a value as indicated in FIG. 9. Occurrence of the depression failure and/or fili-form failure on the surface of each zinc based alloy coating was observed. The results are indicated in FIG. 9. The same procedures as those described above were carried out except that the zinc based alloy contained 0.3% by weight of tin, as an additional element. The results are indicated in FIG. 10.

Figure 10:
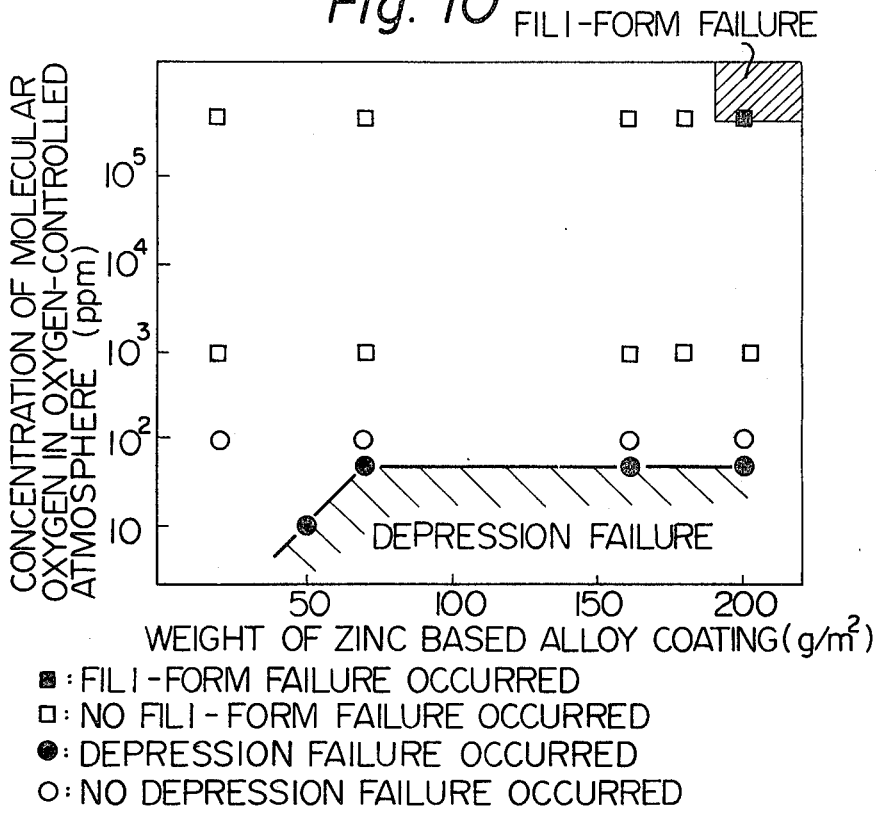
FIG. 10 is a diagram showing other relationships between the content of molecular oxygen in an oxygen-controlled atmosphere, the weight of another melted zinc based alloy coating on a steel strip surface and occurrences of depression failure and fili-form failure in the melted zinc based alloy coating.

Referring to each of FIGS. 9 and 10, a fili-form failure occurred in the hatched region located in the upper portion of the drawing. Also, a depression failure occurred in another hatched region located in the lower portion of the drawing. The depression failure was a common phenomenon in the well known zinc based alloy-coating process. However, the fili-form failure was found only in the magnesium-containing zinc alloy-coating process.

In FIG. 9, when the concentration of molecular oxygen in the oxygen-controlled atmosphere is adjusted to a range of from 100 to 1000 ppm, no depression and fili-form failures occur. However, as indicated in FIG. 10, when the zinc based alloy contains tin, no depression and fili-form failures occur in the oxygen-controlled atmosphere containing from 100 to 100,000 ppm of molecular oxygen. When the weight of the melted zinc based alloy coating is less than about 200 g/m$^2$, more than 100,000 ppm of molecular oxygen in the oxygen-controlled atmosphere do not cause any fili-form failure.

Figure 11:
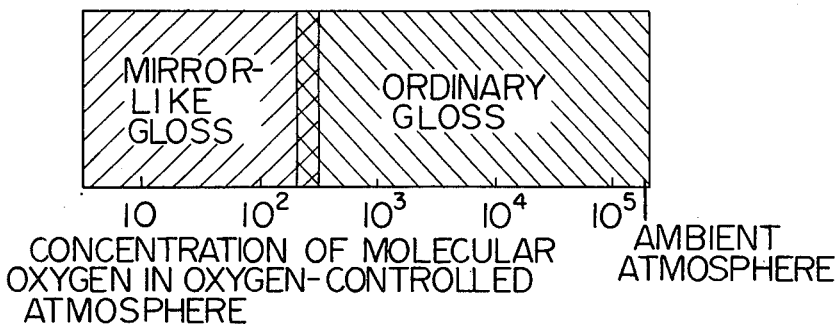
FIG. 11 shows the relationship between the content of molecular oxygen in an oxygen-controlled atmosphere and the appearance of a zinc based alloy coating on a steel strip surface.

The surfaces of the zinc alloy-coated steel strips used for forming FIG. 10, exhibited a gloss as indicated in FIG. 11. Referring to FIG. 11, the concentration of molecular oxygen of 300 ppm or less in the oxygen-controlled atmosphere caused the surface of the resultant coated steel strip to exhibit a spangle-free, mirror-like gloss. However, when the concentration of molecular oxygen was 500 ppm or more, the surface of the resultant coated steel strip had an ordinary gloss. In a range between 300 and 500 ppm, the gloss of the resultant coated steel strip surface was intermediate between the mirror-like gloss and the ordinary gloss. Accordingly, in order to obtain a desired gloss on the coated steel strip, it is important to control the concentration of molecular oxygen in the oxygen-controlled atmosphere. This important feature concerning the magnesium-containing zinc alloy-coating process has never been known before the present invention.

As is clear from the features indicated in FIGS. 6 and 8 through 11, in order to obtain a desired quality of zinc alloy-coated steel strip, it is important that the concentration of molecular oxygen in at least one portion of the oxygen-controlled atmosphere, especially, in the first zone around the wiping gas-jetting nozzles in which zone the weight of the zinc based alloy coating is controlled, be restricted to a specific value. The scope of the coating weight-oxygen-restricted controlling zone (first zone) of the oxygen-controlled atmosphere may be determined in consideration of the occurrence of splash of the melted zinc based alloy, the desired amount of the zinc alloy coating, the composition of the melted zinc based alloy and the speed of the coating procedure. Usually, it is preferable that the coating weight controlling zone of the oxygen-controlled atmosphere is located above the surface of the melted zinc alloy bath and below a level which is 1000 mm above the location of the wiping gas-jetting nozzles. In this coating weight controlling zone of the oxygen-controlled atmosphere, the concentration of molecular oxygen is 1000 ppm or less, preferably, from 50 to 1000 ppm. Also, when the amount of the zinc based alloy coating is in a range of from 50 to 200 g/m$^2$, the concentration of molecular oxygen is preferably in a range of from 100 to 1000 ppm. When the amount of the zinc based alloy coating is less than 50 g/m$^2$, the concentration of molecular oxygen may be in a range of from 10 to 1000 ppm.

The process of the present invention can be carried out by using apparatuses as indicated in FIGS. 12 through 23.

Figure 12:
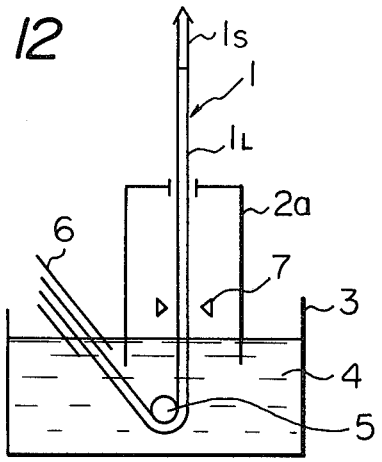
FIG. 12 is an explanatory drawing of an embodiment of apparatuses for carrying out the process of the present invention, in which embodiment means for controlling the weight of a melted zinc based alloy coating on a steel strip surface is arranged in an oxygen-controlled atmosphere.

Referring to FIG. 12, an oxygen-controlled atmosphere is formed in a sealed box 2*a* located above the level of the melted zinc based alloy bath 4 contained in a galvanizing pot 3. A pair of wiping gas-jetting nozzles 7 are located close to the level surface of the melted zinc based alloy bath 4. A steel strip is introduced through a snout 6 into the melt zinc based alloy bath 4 and vertically withdrawn upward through a sink roll 5 from the melted zinc based alloy bath 4. The withdrawn steel strip 1 passes between a pair of wiping gas-jetting nozzle 7. In this stage, the melted zinc based alloy coating is in the fluidal state. The wiping gas streams jetted from the nozzles 7 adjust the weight (thickness) of the melted zinc based alloy on the steel strip surface to a desired value. The coated steel strip 1L with the adjusted weight of the zinc based alloy coating is withdrawn from the sealed box 2*a* and the zinc based alloy coating on the steel strip is completely solidified in the ambient atmosphere above the sealed box 2*a*. That is, a coated steel strip 1S with a solidified zinc based alloy coating is obtained.

Figure 13:
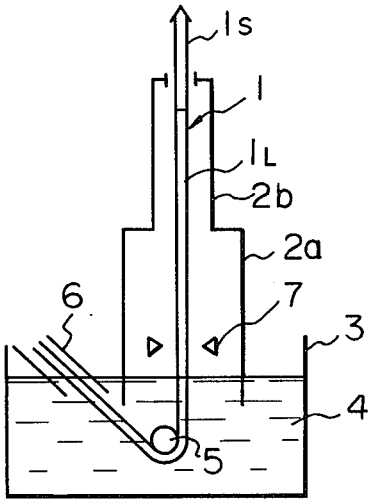
FIG. 13 shows an explanatory drawing of an embodiment of the apparatuses for carrying out the process of the present invention, in which embodiment a solidification procedure for a melted zinc based alloy coating on a steel strip surface is completed within an oxygen-controlled atmosphere.

In the apparatus indicated in FIG. 13, an upper portion of the sealed box 2*a* is connected to a lower portion of an upper sealed box 2*b*. In this upper sealed box 2*b*, the melted zinc based alloy coating on the steel strip is completely solidified at a controlled solidification rate. The concentration of molecular oxygen in the oxygen-controlled atmosphere defined by the upper sealed box 2*b* is also 100 ppm or less.

Figure 14:
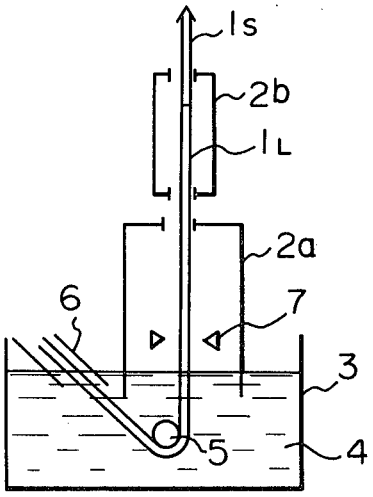
FIG. 14 shows an explanatory drawing of an embodiment of the apparatuses for carrying out the process of the present invention, in which embodiment an oxygen-controlled atmosphere is divided into two portions thereof, that is, a coating weight control zone (*2a*) and a cooling zone (*2b*).

In the apparatus indicated in FIG. 14, an upper sealed box 2*b* is located separately above a lower sealed box 2*a*. In this upper sealed box 2*b*, the melted zinc based alloy coating is completely solidified at a controlled solidification rate.

Figure 15:
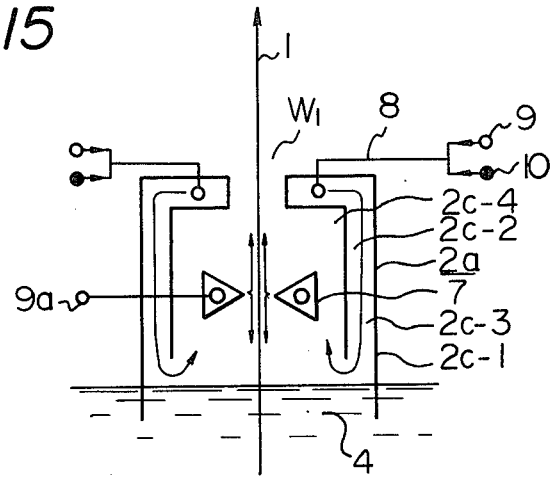
FIG. 15 shows an explanatory view of an embodiment of the apparatus for carrying out the process of the present invention, in which embodiment an oxygen-controlled atmosphere is surrounded by a space connected thereto for mixing a desired amount of molecular oxygen and an inert gas, for example, nitrogen.

In the apparatus shown in FIG. 15, a sealed box 2*a* comprises an outside wall 2C-1 and an inside wall 2C-2. A passage 2C-3 is formed between the outside wall 2C-1 and the inside wall 2C-2. The lower end of the inside wall 2C-2 is spaced from the surface of the melted zinc based alloy bath 4 so as to connect the passage 2C-3 to the inside space 2C-4 defined by the inside wall 2C-2. A pair of wiping gas-jetting nozzles 7 are located in the inside space 2C-4. The nozzles 7 are connected to a source 9*a* of an inert gas. The inert gas is jetted through the nozzles 7 toward the melted zinc based alloy coating on the steel strip.

The passage 2C-3 is connected to a conduit 8 which is connected to a source 9*b* of an inert gas and a source 10 of a gas containing a predetermined amount of molecular oxygen, for example, air. The inert gas is mixed with the oxygen-containing gas and, the mixed gas is introduced into the inside space 2C-4 through the passage 2C-3 to provide an oxygen-controlled atmosphere.

The pressure of the oxygen-controlled atmosphere in the sealed box 2*a* is maintained at a level 5 to 10 mm $H_2O$ above the ambient atmospheric pressure. Therefore, the atmospheric air is hindered, from entering the inside of the sealed box 2*a* through an exit $W_1$ for the coated steel strip, formed in the top portion of the sealed box 2*a*. When the gas fed from the source 10 contains no molecular oxygen, the content of the molecular oxygen in the oxygen-controlled atmosphere is 10 ppm or less.

Figure 16:
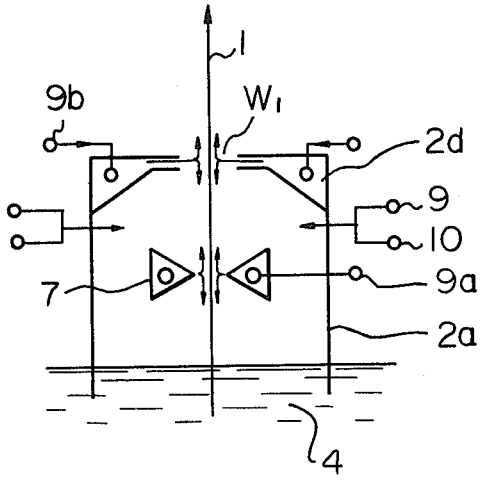
FIG. 16 is a explanatory view of an embodiment of the apparatus for carrying out the process of the present invention, in which embodiment means for blowing a cooling gas is arranged above means for controlling the weight of a melted zinc based alloy coating on a steel strip surface.

In the apparatus indicated in FIG. 16, a gas mixture of an inert gas supplied from a source 9 and a gas containing a predetermined amount of molecular oxygen and supplied from a source 10, is directly introduced into the inside of the sealed box 2*a* to provide an oxygen-controlled atmosphere. A chamber 2*d* is formed in the upper portion of the sealed box 2*a*. The chamber 2*d* is provided with a slit surrounding an exit $W_1$ of the sealed box 2*a*. The chamber 2*d* is connected to a source 9*b* of an inert gas. The inert gas is introduced into the chamber 2*b* and, then, jetted through the slit toward a steel strip passing through the exit $W_1$, so as to form a curtain of an inert gas stream. The inert gas curtain is effective for shutting off the atmospheric air from the inside of the sealed box 2*a*.

Figure 17:
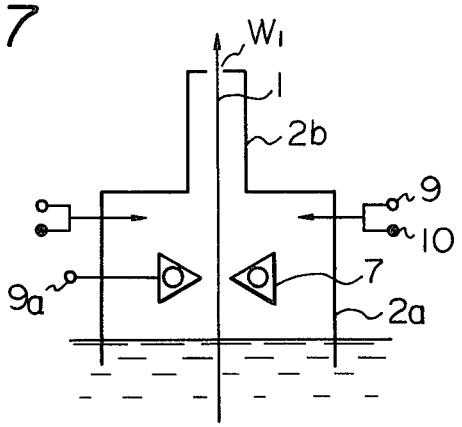
FIG. 17 is an explanatory view of an embodiment of the apparatus for carrying out the process of the present invention, in which embodiment a melted zinc based alloy coating on a steel strip surface is completely solidified within an oxygen-controlled atmosphere consisting of a mixture of air with an inert gas.

In the apparatus as indicated in FIG. 17, an inert gas supplied from its source 9*a* is jetted through a pair of wiping gas-jetting nozzles 7 into the inside of the sealed box 2*a*. Also, a mixture of an inert gas supplied from its source 9 and a gas containing a predetermined amount of molecular oxygen and supplied from its source 10 is directly introduced into the inside of the sealed box 2*a*. An upper portion of the sealed box 2*a* is connected to a lower portion of a long upper sealed box 2*b*. Therefore, the inside of the sealed box 2*a* and the upper sealed box 2*b* is filled with an oxygen-controlled atmosphere. This long upper sealed box 2*b* is effective for preventing undesirable contamination of the atmospheric air by the oxygen-controlled atmosphere in the sealed box 2*a*.

Figure 18:
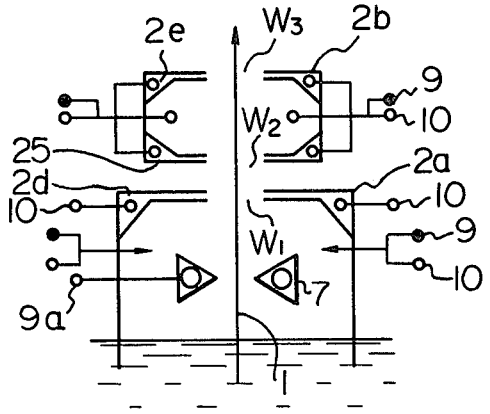
FIG. 18 is an explanatory drawing of an embodiment of the apparatus for carrying out the process of the present invention, in which embodiment a steel strip coated with a melted zinc based alloy is introduced into a first oxygen-controlled atmosphere in which means for controlling the weight of the melted zinc based alloy coating is contained and, then, into a second oxygen-controlled atmosphere in which the melted zinc based alloy coating is completely solidified, the location of the second atmosphere being movable and the first and second atmospheres each consisting of a mixture of air and an inert gas.

In the apparatus as indicated in FIG. 18, the sealed box 2*a* is the same as that indicated in FIG. 16, except that the chamber 2*d* is connected to a source 10 of a gas containing a predetermined amount of molecular oxygen.

An upper sealed box 2*b* which is separated from the sealed box 2*a* is arranged above the sealed box 2*a*. The upper sealed box 2*b* is provided with an upper chamber 2*e* and a lower chamber of 2*f* each having a slit surrounding the path of the coated steel strip 1. A gas mixture is prepared from an inert gas supplied from its source 9 and a gas containing a predetermined amount of molecular oxygen. A portion of the gas mixture is directly introduced into the inside of the upper sealed box 2*b*, another portion of the gas mixture is introduced into the upper chamber 2*e* and, then, jetted through the slit toward the entrance $W_2$ of the upper sealed box 2*b* and the other portions of the gas mixture is introduced into the lower chamber of 2*f* and, then, jetted through the slit toward the exit $W_3$ of the upper sealed box 2*b*.

The melted zinc based alloy coating layer on the steel strip is completely solidified while the steel strip stays in the upper sealed box 2b.

Figure 19:
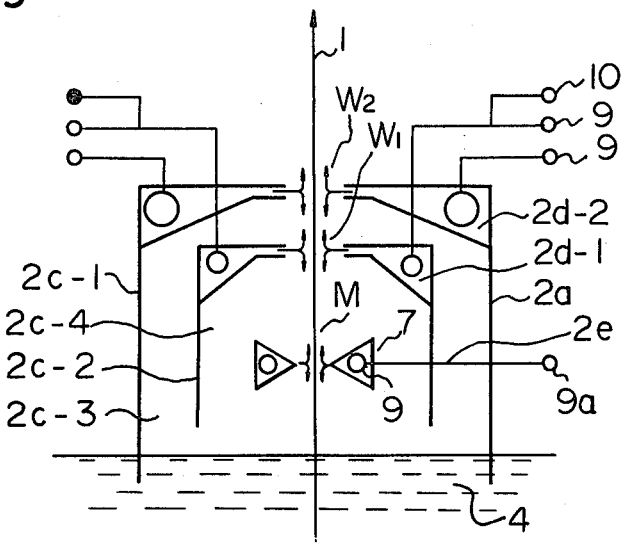
FIG. 19 is an explanatory drawing of an embodiment of the apparatus for carrying out the process of the present invention, in which embodiment a steel strip coated with a melted zinc based alloy is introduced into a first oxygen-restricted atmosphere and, then, into a second cooling atmosphere surrounding the first atmosphere, a mixture of air and an inert gas being blown toward the zinc based alloy coating on the steel strip surface at an outlet of the first atmosphere and an inert gas being blown toward the zinc based alloy coating on the steel strip surface at an outlet of the second atmosphere.

In the apparatus indicated in FIG. 19, an inert gas supplied from its source 9a is jetted into the inside of an inside wall 2C-2 through a pair of nozzles 7. A mixture of an inert gas supplied from its source 9 and a gas containing a predetermined amount of molecular oxygen and supplied from its source 10, is introduced into an inside upper chamber 2d-1 formed in the upper portion of the inside wall 2c-2, and, then, jetted through a slit surrounding an inside exit $W_1$ of the inside wall 2c-2. A passage 2c-3 is formed between the inside wall 2c-2 and an outside wall 2c-1. Since the lower end of the inside wall 2c-2 is spaced from the surface of the zinc based alloy bath 4, the passage 2c-3 is connected to the inside pace 2c-4 surrounded by the inside wall 2c-2. An outside upper chamber 2d-2 is formed in the upper portion of the outside wall 2c-1. An inert gas is introduced into the upper chamber 2d-2 and, then, jetted through a slit surrounding an outside exit $W_2$ of the passage 2c-4. The jet stream of the inert gas forms an outside curtain for shutting off the passage 2c-3 from the outside atmosphere. A portion of the jetted inert gas flows into the passage 2c -3 and then, into the inside space 2c-4.

The jet stream of the mixture gas also forms an inside curtain for shutting off the inside space 2c-4 from the passage 2c-3. A portion of the jetted gas mixture directly flows into the inside space 2c-4 and the remaining portion of the jetted gas mixture flows into the passage 2c-3 and, then, into the inside space 2c-4.

In an example of the process of the present invention, the apparatus shown in FIG. 19 was employed. The nozzles 7 were located 150 mm above the surface of the melted zinc based alloy bath 4. The inside and outside exits $W_1$ and $W_2$ had a width of 20 mm.

Figure 20:
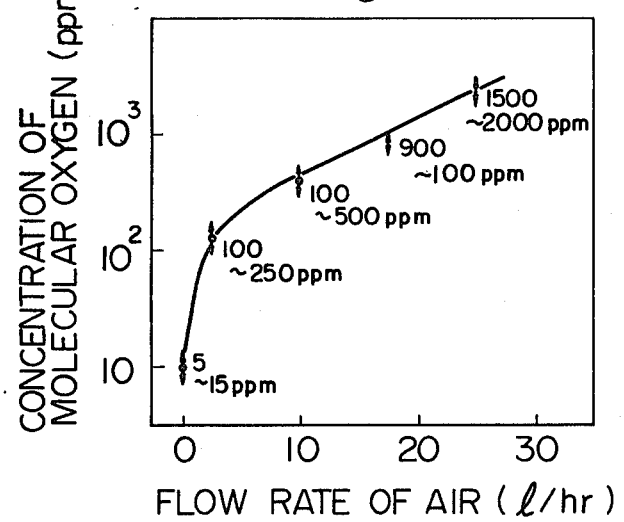
FIG. 20 is a graph showing a relationship between the content of air in the mixture blown into the first oxygen-controlled atmosphere shown in FIG. 19 and the content of molecular oxygen at a point M in the first oxygen-controlled atmosphere as shown in FIG. 19.

A steel strip having a width of 150 mm was coated at a speed of 80 m/min by using the apparatus shown in FIG. 19. Nitrogen gas was introduced into the outside upper chamber 2d-2 and jetted through the slit at a flow rate $Q_1$ of 26 $m^3$/hr. A mixture of nitrogen gas at a flow rate $Q_2$ of 16 $m^3$/hr and air at a flow rate $Q_3$ of 2.5, 10, 17.5 or 2.5 l/hr was introduced into the inside upper chamber 2d-1 and jetted through a slit. Also, nitrogen gas was jetted through the nozzles 7 each having a slit width of 400 mm and a slit thickness of 0.3 mm, under a pressure of 0.5 kg/$cm^2$. The nozzles 7 were spaced 30 mm from each other. When no air was fed, the concentration of molecular oxygen in the oxygen-controlled atmosphere in the inside space 2c-4 became 5 to 15 ppm. The relationship between the flow rate $Q_3$ of air and the concentration of molecular oxygen is indicated in FIG. 20. That is, the flow rate $Q_3$ of air of 2.5, 10, 17.5 and 25 l/hr resulted in concentrations of molecular oxygen of from 100 to 250, from 100 to 500, from 900 to 1000 and from 1500 to 2000 ppm, respectively. The concentration of molecular oxygen was measured at a location M indicated in FIG. 19. The location M is 50 mm above the nozzles 7 and spaced 30 mm from the inside wall 2c-2.

Figure 21:
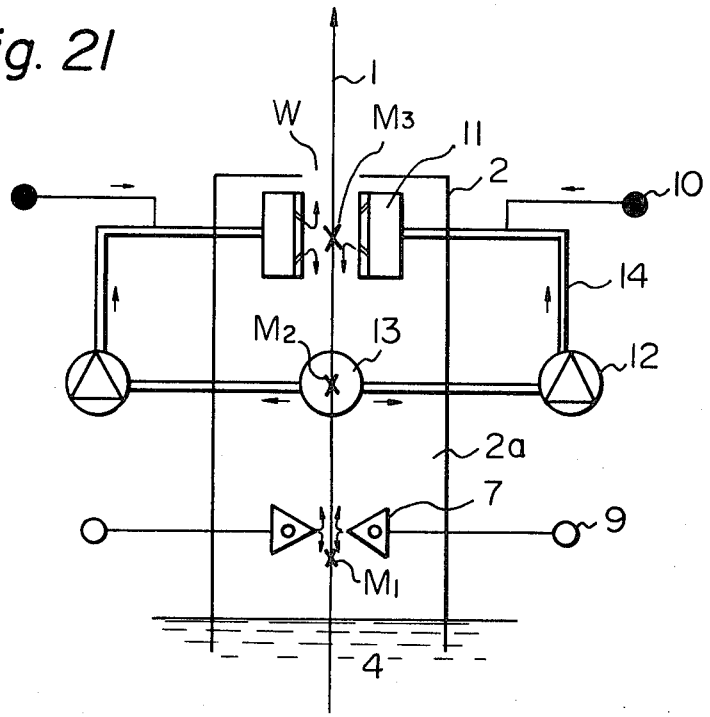
FIG. 21 shows an explanatory drawing of an embodiment of the apparatus for carrying out the process of the present application, in which embodiment a gas stream withdrawn from an oxygen-controlled atmosphere is blown toward a zinc based alloy coating on a steel strip surface at an outlet portion of said atmosphere, in order to prevent undesirable generation of vibration of the steel strip.

In the apparatus shown in FIG. 21, a pair of air cushion pats (ACP) 11 were arranged in the upper portion in the sealed box 2a. A portion of the gas contained in the sealed box 2a is withdrawn from a hole 13 formed at a location $M_2$ which is in a center portion of the sealed box 2a and fed to the air cushion pats 11 through conduits 14 by means of blowers 12. In the conduit 14, the withdrawn gas is mixed with a predetermined amount of a molecular oxygen-containing gas supplied from a supply source 10. Separately, an inert gas is jetted through the nozzles 7 into the inside of the sealed box 2a. If it is necessary, a mixture of an inert gas and molecular oxygen may be supplied into an upper portion and/or lower portion of the inside space of the sealed box 2a. The streams of gas mixture jetted from the air cushion pats 11 is effective for preventing undesirable vibration of the steel strip and for shutting off the inside of the sealed box 2a from the outside atmosphere. The opening area of the exit W in the upper end of the sealed box 2b can be small when the air cushion pats are used.

An example of the process of the present invention was carried out by using the apparatus shown in FIG. 21. A steel strip having a width of 150 mm was coated at a speed of 80 m/min. Each air cushion pat had a slit (100×100×3 mm). The flow rate of the mixture gas supplied to the air cushion pats was 4.4 $m^3$/min. The pats were spaced 30 mm from each other.

The nozzles 7 each had a slit having a width of 350 mm and a thickness of 0.5 mm and spaced 20 mm from each other. The nitrogen gas was jetted at a flow rate of 3.9 $m^3$/min under a pressure of 1.0 kg/$cm^2$. The ratio of the flow rate of the gas mixture supplied to the air cushion pats 11 to the inert gas supplied to the nozzle 7 was 1.4:1 or less. When the ratio was more than 1.4:1, the pressure in the inside of the sealed box 2a was negative. This negative pressure caused the atmospheric air to be sucked into the inside of the sealed box 2a. In this case, it was necessary to introduce an additional amount of inert gas, for example, nitrogen gas.

The concentration of molecular oxygen in the oxygen-controlled atmosphere inside the sealed box 2a was measured at locations $M_1$, $M_2$ and $M_3$ indicated in Table 1. The results are indicated in FIG. 22.

Figure 22:
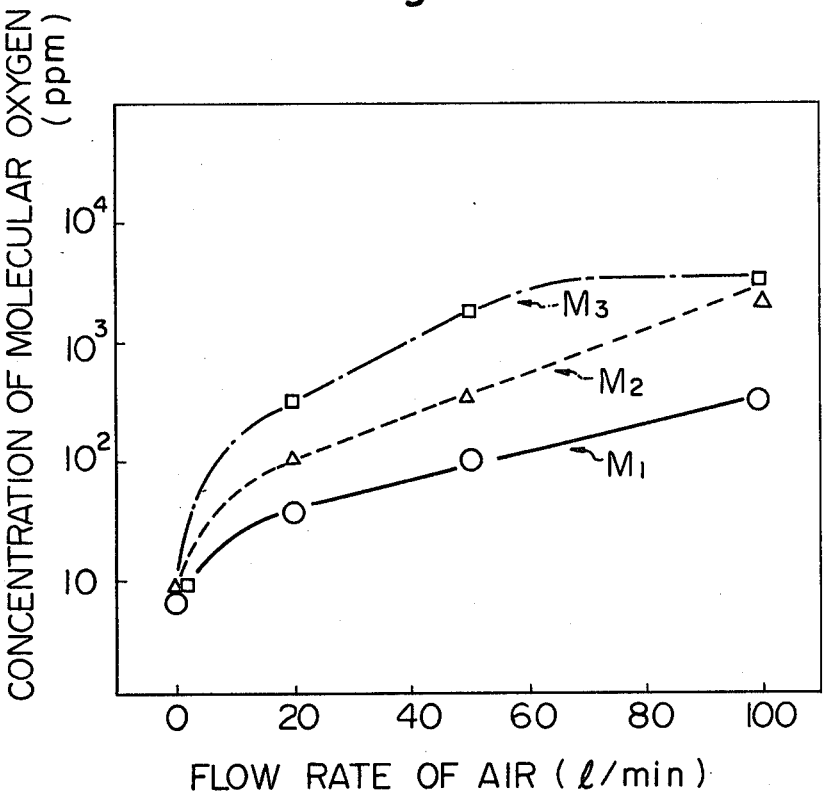
FIG. 22 shows a diagram of the relationship between the amount of air introduced into the oxygen-controlled atmosphere in the apparatus as shown in FIG. 23 and the contents of molecular oxygen at three locations in the oxygen-controlled atmosphere.

FIG. 22 shows that when no air is supplied, the concentration of molecular oxygen in the oxygen-controlled atmosphere in the sealed box 2a is about 10 ppm. The relationship between the flow rate of air, 20 l/min, 50 l/min or 100 l/min, and the concentration of molecular oxygen is as follows.

| | Concentration of molecular oxygen (ppm) | | |
|---|---|---|---|
| Air flow rate (l/min) | Location $M_1$ | Location $M_2$ | Location $M_3$ |
| 20 | 50 | 100 | 500 |
| 50 | 100 | 500 | 2000 |
| 100 | 500 | 2000 | 5000 |

Figure 23:
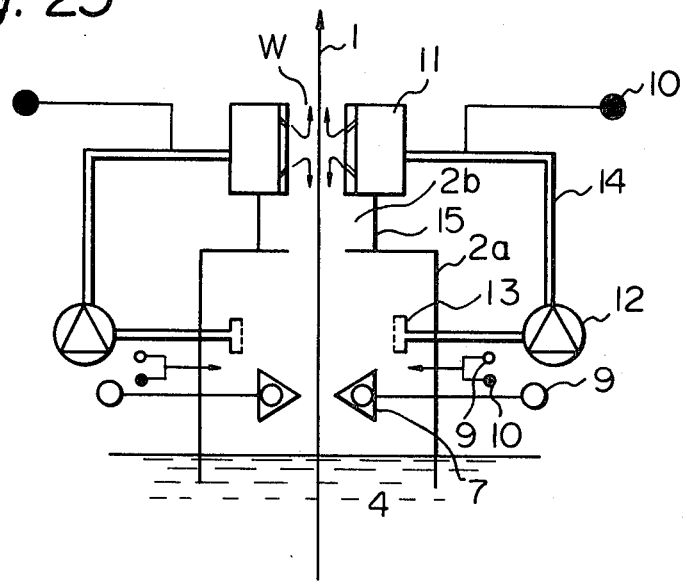
FIG. 23 shows an explanatory drawing of an embodiment of the apparatus for carrying out the process of the present invention, in which embodiment a gas stream withdrawn from an oxygen-controlled atmosphere is blown toward a zinc based alloy coating on a steel strip surface, at an outlet of the oxygen-controlled atmosphere.

In the apparatus indicated in FIG. 23, an upper sealed box 2b is connected to a lower sealed box 2a and a pair of air cushion pats 11 are arranged in the top portion of the upper sealed box 2b so that an exit W is formed between the pats 11. A portion of the gas contained in the lower sealed box 2a is withdrawn from holes 13 located in the middle portion of the lower sealed box 2a by means of closed blowers 12 and, if necessary, mixed with a molecular oxygen-containing gas supplied from a source 10. The gas mixture is jetted through the air cushion pats 11. The oxygen-controlled atmosphere in the sealed box 2a is prepared from an inert gas supplied from a source 9 and a molecular oxygen-containing gas supplied from a source 10.

The apparatuses usable for carring out the process of the present invention is not limited to those mentioned above. The process of the present invention can be carried out by using another apparatus as long as the concentration of molecular oxygen in the oxygen-controlled atmosphere can be adjusted to a specific value.

The following specific examples are presented for the purpose of clarifying the present invention. However, it should be understood that these are intended only to be examples of the process of the present invention and are not intended to limit the scope of the present invention in any way.

EXAMPLES 1 THROUGH 7

In each of the Examples 1 through 7, a zinc alloy containing magnesium and tin in amounts indicated in Table 2, 0.2% by weight of aluminum and impurities containing 0.15% by weight of lead, 0.01% by weight of cadmium and 0.01% by weight of iron, was melted at a temperature of 450° C.

By using an apparatus as indicated in FIG. 21, the concentration of molecular oxygen in the oxygen-controlled atmosphere was adjusted to 50 ppm at a location $M_1$, 100 ppm at a location $M_2$ and 500 ppm at a location $M_3$. A steel strip was coated with the melted zinc based alloy bath at a speed of 50 m/min. The amount of the zinc based alloy coating was adjusted to 50 g/min$^2$ by jetting a wiping gas at a pressure of 1.0 kg/cm$^2$ through a pair of nozzles spaced 20 mm from each other. Throughout the hot dip galvanizing procedure, no difficulty due to the formation of dross and the generation of metal vapor occurred. The proprties of the coated steel strips are indicated in Table 2.

weight in Example 16. The properties of the resultant coated steel strips were similar to those in Example 6.

We claim:

1. A process for producing a hot dip galvanized sheet strip comprising the steps of:

coating at least one surface of a steel strip with a melt of a zinc-based alloy containing 0.1 to 2% by weight of magnesium;

controlling the weight of the melted zinc-based alloy coating formed on said steel strip surface; and solidifying said melted zinc-based alloy coating, in which process in at least a portion of a stage in which said melted zinc-based alloy coating is still in the liquid state, said melted zinc-based alloy coating is exposed to an oxygen-controlled atmosphere containing 50 to 1000 ppm of molecular oxygen and the weight of said melted zinc-based alloy coating is controlled in said oxygen-controlled atmosphere.

2. The process as claimed in claim 1, wherein said coating procedure comprises immersing said steel strip into a bath consisting of said melted zinc based alloy and, then, upwardly removing said steel strip from said melted zinc based alloy bath.

3. The process as claimed in claim 1, wherein said controlling procedure of the weight of said zinc based alloy coating comprises jetting a stream of said oxygen controlled atmosphere onto said melted zinc based alloy coating through wiping nozzles.

TABLE 2

| Example No. | content (wt %) Mg | Sn | Appearance: Skimming | Depression failure | Fili-form failure | Adhesion(*)$_1$ of zinc based alloy coating to steel strip | darkening(*)$_2$ (38° C. 6 months): chromate-treated | non-treated | Intergranular corrosion in steam atmosphere (2 weeks) | Corrosion loss (g/m$^2$) due to salt spray test(*)$_3$ (72 hours) |
|---|---|---|---|---|---|---|---|---|---|---|
| 1 | 0.2 | 0.1 | no | no | no | excellent | no | no | no | 2.1 |
| 2 | 0.5 | 0.1 | " | " | " | " | " | " | " | 7.5 |
| 3 | " | 0.3 | " | " | " | " | " | " | " | 7.2 |
| 4 | " | 0.5 | " | " | " | " | " | " | " | 7.5 |
| 5 | 1.0 | 0.1 | " | " | " | " | " | " | " | 5.0 |
| 6 | " | 0.3 | " | " | " | " | " | " | " | 5.5 |
| 7 | " | 0.5 | " | " | " | " | " | " | " | 5.2 |

Note:
(*)$_1$—Ball-impact test
(*)$_2$—Test pieces were superimposed on each other and wrapped
(*)$_3$—JIS Z 2371

EXAMPLES 8 THROUGH 14

In Example 8 through 14, the same procedures as those described in Example 1 through 7 were carried out respectively, except that the apparatus as indicated in FIG. 19 was used and the concentration of molecular oxygen in the portion around the wiping gas-jetting nozzles placed in the oxygen-controlled atmosphere was adjusted to from 100 to 250 ppm. The solidification of the plated zinc alloy melts was completed outside the oxygen-controlled atmosphere. The resultant plated steel strip in Example 8 through 14 exhibited similar properties as those of Examples 1 through 7, respectively.

EXAMPLES 15 AND 16

In each of the Examples 15 and 16, the same procedures as those described in Example 6 were carried out, except that the concentration of aluminum in the zinc alloy was 0.1% by weight in Example 15 and 0.5% by

4. The process as claimed in claim 2, wherein said oxygen-controlled atmosphere is formed in a region having a height of at least one meter from the upper surface of the melted zinc based alloy bath and surrounding the path of said steel strip removed upwardly from said melted zinc based alloy bath.

5. The process as claimed in claim 1, wherein after passing through said oxygen-controlled atmosphere, said steel strip with said melted zinc based alloy coating is introduced into another oxygen-controlled atmosphere containing molecular oxygen in a content of 1000 ppm or more but not exceeding the content of molecular oxygen in the ambient atmosphere.

6. The process as claimed in claim 1, wherein said zinc based alloy comprises 0.1 to 2.0% by weight of magnesium and the balance consisting essentially of zinc.

7. The process as claimed in claim 1, wherein said zinc based alloy comprises 0.1 to 2.0% by weight of magnesium, 0.5% or less of aluminum and the balance consisting essentially of zinc.

8. The process as claimed in claim 7, wherein the content of aluminum is in a range of 0.1 to 0.5% by weight.

9. The process as claimed in claim 1, wherein said zinc based alloy contains substantially no aluminum.

10. The process as claimed in claim 1, wherein said zinc based alloy comprises 0.1to 2.0% by weight of magnesium, 0.1 to 0.8% by weight of tin and the balance consisting essentially of zinc.

11. The process as claimed in claim 1, wherein said zinc based alloy comprises (A) 0.1 to 2.0% by weight of magnesium, (B) 0.1% to 5.0% by weight of aluminum, (C) tin in a content of from 0.1% by weight to an upper limit A satisfying the equation:

$$A(\%)=1.07-1.33\times B$$

wherein B represents a content in % of aluminum and (0) the balance consisting essentially of zinc.

12. The process as claimed in claim 10, wherein at least a portion of said tin to be contained in said zinc based alloy is replaced by at least one member selected from the group consisting of bismuth, antimony and silicon.

13. The process as claimed in claim 11, wherein at least a portion of said tin to be contained in said zinc based alloy is replaced by at least one member selected from the group consisting of bismuth, antimony and silicon.

* * * * *